US005209489A

United States Patent [19]

Dorny et al.

[11] Patent Number: 5,209,489

[45] Date of Patent: May 11, 1993

[54] BALL RETURN DEVICE

[76] Inventors: Christopher M. Dorny, C-2107 Helaman Halls, Brigham Young University, Provo, Utah 64604; Scott N. Dorny, 2 Park Pl. #25G, Hartford, Conn. 06106

[21] Appl. No.: 801,406

[22] Filed: Dec. 2, 1991

[51] Int. Cl.[5] ..... G09B 67/20

[52] U.S. Cl. ..... 273/321

[58] Field of Search ..... 273/321, 58 C, 319, 273/320, 322, 323, 326, 329, 330, 331, 334, 413, 414

[56] References Cited

U.S. PATENT DOCUMENTS

| | | | |
|---|---|---|---|
| 2,142,527 | 1/1939 | Pool | 273/326 |
| 2,512,239 | 6/1950 | Singer | 273/321 |
| 3,623,725 | 11/1971 | Setten, Sr. | 273/58 C |
| 4,071,239 | 1/1978 | Ferguson | 273/58 C X |
| 4,272,076 | 6/1981 | Song et al. | 273/58 C |
| 4,867,451 | 9/1989 | Mitchell | 273/58 C |

*Primary Examiner*—William Grieb

[57] ABSTRACT

A ball return device which is a attached to a throwing and catching apparatus, such as a lacrosse stick, so that a person can play alone. Rubber tubing is permanently attached to a ball and releasably attached to the throwing and catching apparatus. When the ball is thrown, the tubing stretches and causes the ball to return toward the user.

9 Claims, 4 Drawing Sheets

BALL RETURN DEVICE

FIELD OF THE INVENTION

The invention relates generally to device for returning a ball to a thrower. The ball is attached to a throwing and catching device, which can be used without a partner and without losing the ball.

BACKGROUND OF THE INVENTION

Throwing and catching devices, such as lacrosse sticks, generally require the presence of at least two people to use them. The people can play or practice by throwing a ball back and forth between them. Such throwing and catching devices are not very useful when a person is alone or has only one of them.

A number of devices have been developed to provide a means for returning a ball to the thrower without another person. The ball can be thrown against a wall, either especially designed for this or part of a building. Other devices provide elastic netting which rebounds a ball when thrown against it. However, these devices are not easily portable, cannot be used in small areas, such as indoors, and cause the ball to rebound in awkward directions, which then requires retrieval.

SUMMARY OF THE INVENTION

A need exists to provide a simple device which returns a ball to the thrower to allow an individual to have a catch without a partner being needed and without chasing the ball. It is an object of the invention to make catching devices more usable by a single individual. It is another object of this invention to provide a simple, portable device which can be used in many locations.

With these and other objects, advantages and features of the invention that may become apparent, the nature of the invention may be more clearly understood by reference to the following detailed description of the invention, the appended claims and to the several drawings attached herein.

DESCRIPTION OF THE PREFERRED EMBODIMENT

Figure 1:
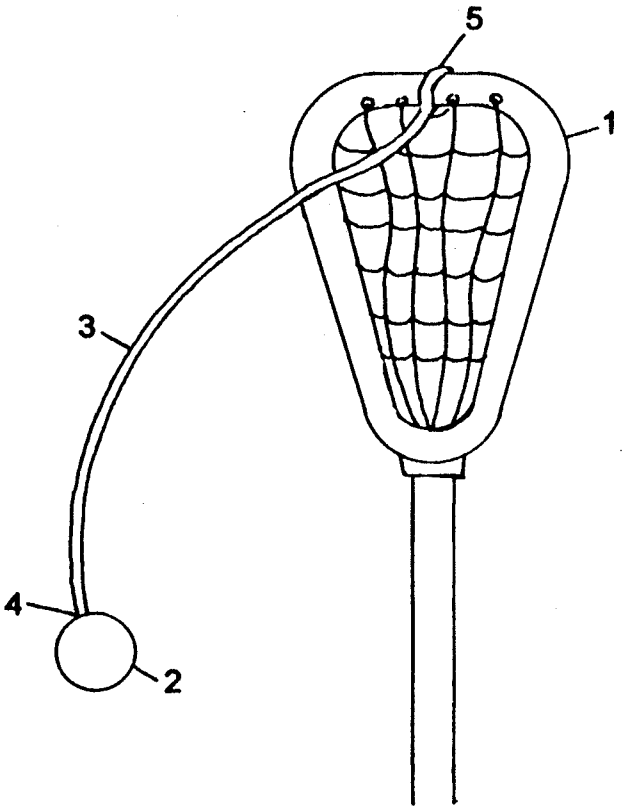
FIG. 1 is a front view of the device of the present invention shown connected to a head of a lacrosse stick.

Referring now in detail to the drawings wherein like parts are designated by like reference numerals throughout, the principal components of the present invention are shown in FIG. 1. A flexible, elastic connector 3, such as rubber tubing, is used to connect a ball 2 to a throwing and catching device 1, such as a lacrosse stick as shown. As explained more fully below, the flexible, elastic connector 3 is permanently attached by some means 4 to the ball 2. It is also attached, preferably releasably, by a loop 5 at some position on the throwing and catching device 1. Preferably, the flexible elastic connector 3 would be attached near the area used to throw and catch the ball. In normal operation, the flexible, elastic connector 3 stretches when the ball 2 is thrown. Therefore, the ball 2 returns to the throwing and catching device 1.

Figure 2:
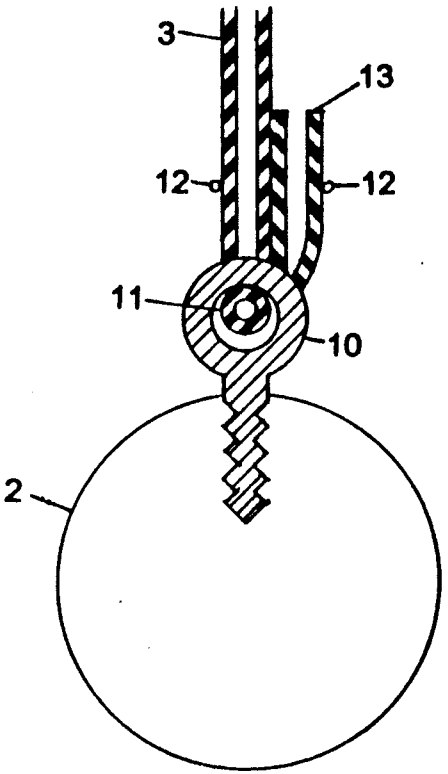
FIGS. 2–4 are cross sectional views of three embodiments for attaching a ball to the connector.
Figure 4:
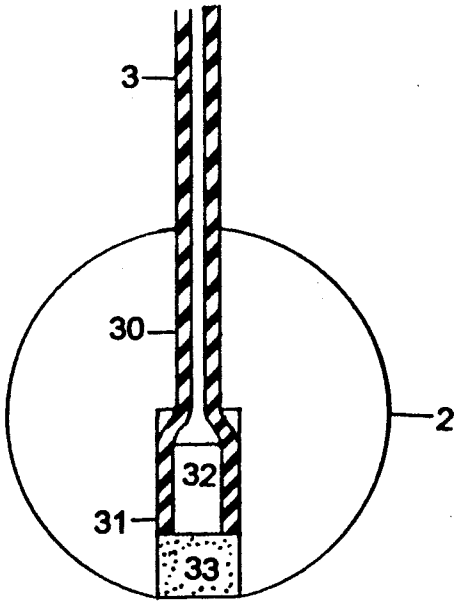
Figure 3:
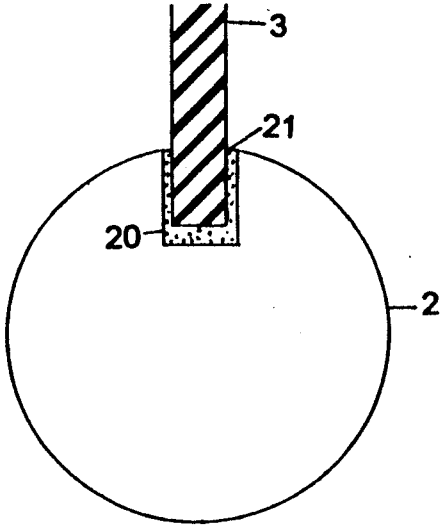

Several means 4 for attaching the ball 2 to the flexible, elastic connector 3 are shown in FIGS. 2–4. According to a first embodiment, shown in FIG. 2, a metal hook 10, such as an eye hook, is inserted in the ball 2. Alternatively, the hook 10 could extend through the ball 2 and be secured by a nut or other fastener (not shown). A loop 11 is formed in the flexible, elastic connector 3 through the metal hook 10. The free end 13 of the connector 3 is secured to the extending portion to form the loop 11. A metal clip 12 is wrapped around both parts of the flexible, elastic connector 3 to provide one method for securing the free end 13.

In a second embodiment, shown in FIG. 3, the flexible, elastic connector 3 is inserted in a hole 20 in the ball 2. An adhesive 21 is used to secure the connector 3 to the ball 2.

FIG. 4 illustrates a cross section view of a third embodiment for attaching the flexible elastic connector 3 to a solid rubber ball 2. Rubber tubing is used as the connector 3 and is inserted in a hole in the ball 2, which has a small diameter section 30 and a large diameter section 31. A plug 32 is placed in the end of the rubber tubing 3 within the large diameter section 31 to keep the rubber tubing 3 in place. Glue 33 is used to fill the surface of the hole.

FIGS. 5–9 illustrate three embodiments for the loop 5 to attach the flexible, elastic connector 3 to the throwing and catching device 1. In a first embodiment, shown in FIG. 5, a loop 40 is formed in the flexible, elastic connector 3 and is secured with a metal clip 44. The loop must be large enough that, when stretched, the ball 2 can pass through it. To attach the connector 3, it is wrapped around a portion of the throwing and catching device 1 and the ball 2 is pushed through the loop 40 to form a second loop 42 around a portion of the throwing and catching device 1.

Figure 6:
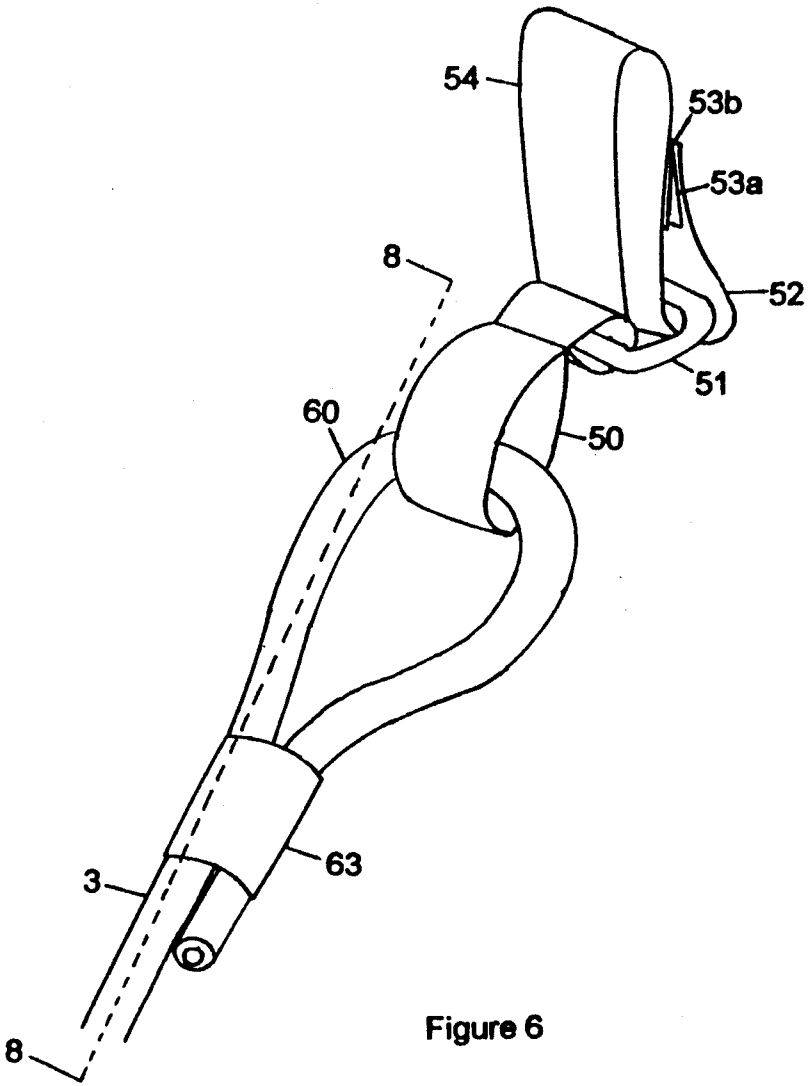
FIGS. 6–8 are parts of a second embodiment for attaching the device.
Figure 5:
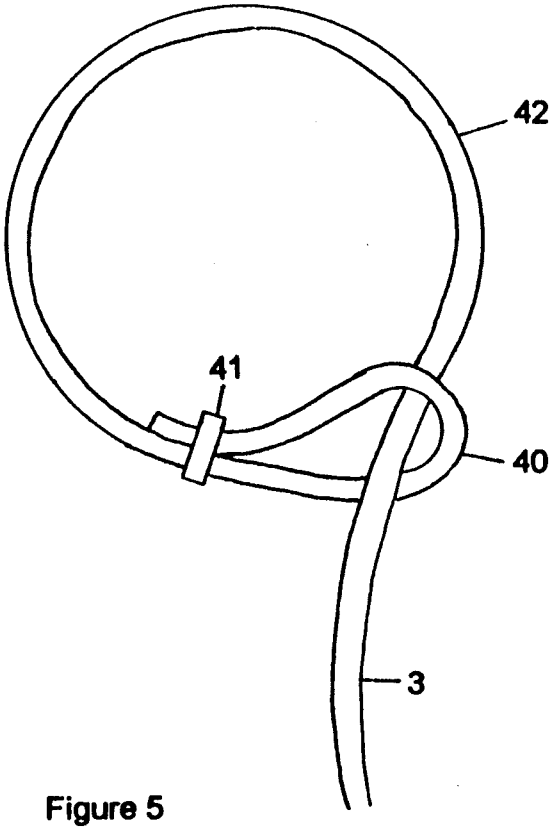
FIG. 5 is a first embodiment for attaching the device of the present invention to a throwing and catching device.
Figure 8:
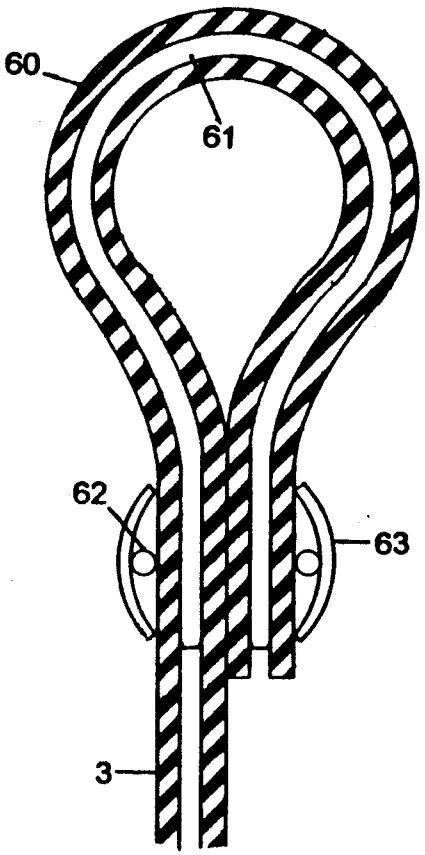
Figure 7:
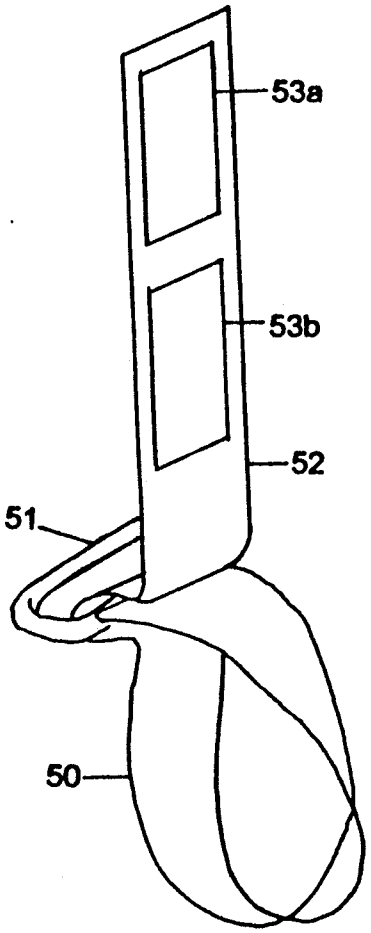

A second embodiment for attaching the connector 3 is shown in FIGS. 6–8. As shown in FIG. 6, a loop 60 is formed in the end of the connector, as more fully described with respect to FIG. 8. A flexible, inelastic material is formed into two loops 50, 54 as more fully described with respect to FIG. 7. The first loop 50 is disposed within the loop 60 of the flexible, elastic connector 3. The second loop 54 can be formed around a portion of the throwing and catching device 1 to attach the connector 3.

FIG. 7 shows an attachment for the second embodiment of the connection. An flexible, inelastic material, such as nylon webbing, is formed into a loop 50 with an extending portion 52. A metal ring 51, preferably formed in a rectangle, is attached to the loop 50. Releasable connections **53*a*, 53*b* are attached to the extending portion 52. The releasable connections 53*a*, 53*b* could include snaps or Velcro TM. The extending portion 52 is passed through the metal ring 51 and the releasable connections 53*a*, 53*b* are connected to form loop 54, as shown in FIG. 6**.

FIG. 8 shows a cross sectional view, along the line 8—8 in FIG. 6, of the preferred means for forming a loop 60 in the flexible, elastic connector 3. A piece of rope 61 is disposed in the area of the loop 60 within rubber tubing used as the flexible, elastic connector 3.

The rope 61 limits the elasticity of the rubber tubing in the area of the loop 60. A metal clip 62 is disposed around the rubber tubing 3 to secure the end. A covering 63, such as shrink wrap, is formed around the rubber tubing 3 and the metal clip 62.

Figure 9:
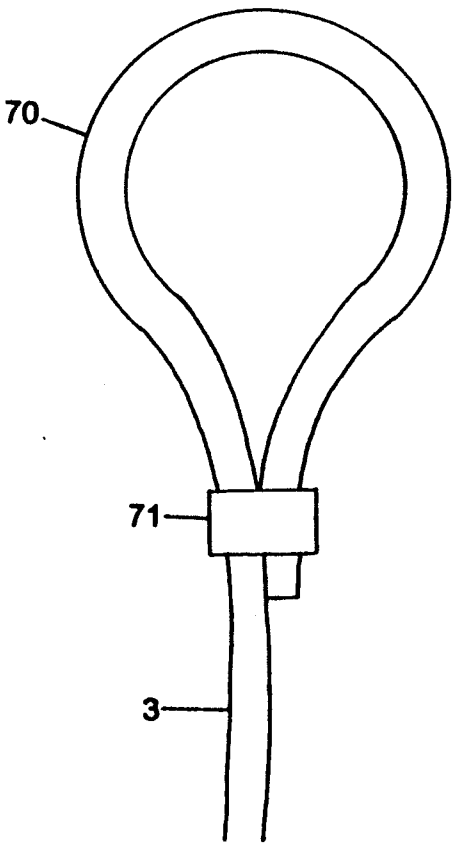
FIG. 9 is a third embodiment for attaching the device.

A third embodiment, as shown in FIG. 9, provides a permanent attachment of the flexible, elastic connector 3 to the throwing and catching device 1. A loop 70 is formed around a portion of the throwing and catching device. The loop is secured by a metal clip 71, to permanently attach the connector 3.

It will be appreciated that modifications and variations of the present invention are covered by the above teachings and within the purview of the appended claims without departing from the spirit and intended scope of the invention.

We claim:

1. A device for attaching a ball to a catching and throwing apparatus, said catching and throwing apparatus having a substantially rigid peripheral portion, comprising:

a flexible, elastic connector;

ball attachment means for attaching said ball to a first end of said flexible, elastic connector; and connector attachment means for attaching a second end of said flexible, elastic connector to said peripheral portion of said catching and throwing apparatus, including a loop in said second end of said flexible, elastic connector, and a flexible material, disposed within said loop in said second end of said flexible, elastic connector, for releasably attaching said flexible, elastic connector to said throwing and catching apparatus.

2. The device of claim 1 wherein said catching and throwing apparatus is a lacrosse stick.

3. The device of claim 1 wherein said flexible, elastic connector is rubber tubing.

4. The device of claim 1 wherein said ball attachment means comprises gluing said flexible, elastic connector to said ball.

5. The device of claim 1 wherein said ball attachment means comprises:

a hole through said ball having a small diameter portion and a large diameter portion;

said first end of said flexible, elastic connector being disposed within said hole and extending from said small diameter portion; and plug means disposed within said large diameter portion so that said flexible, elastic connector cannot be withdrawn.

6. The device of claim 5 further comprising filler means within said large diameter portion such that the surface of said filler means is level with the surface of said ball.

7. The device of claim 1, wherein said flexible material is substantially inelastic.

8. The device of claim 1 wherein said flexible material comprises:

a permanent first loop disposed within said loop in said second end of said flexible, elastic connector; and an extending portion with releasable connectors such that said extending portion forms a second loop when said releasable connectors are connected.

9. A device for attaching a ball to a catching and throwing apparatus, said catching and throwing apparatus having a substantially rigid peripheral portion, comprising:

a flexible, elastic connector;

ball attachment means for attaching said ball to a first end of said flexible, elastic connector; and connector attachment means for attaching a second end of said flexible, elastic connector to said peripheral portion of said catching and throwing apparatus, including a first loop in said second end of said flexible, elastic connector, and a second loop in said end of said flexible, elastic connector, wherein said first loop is disposed about a portion of said flexible elastic connector to form said second loop and said second loop is disposed about said peripheral portion of said catching and throwing device.

* * * * *